United States Patent [19]

Zeravica

[11] Patent Number: 4,581,833

[45] Date of Patent: Apr. 15, 1986

[54] OFFSET SHOVEL ASSEMBLY FOR USE WITH BACKHOE

[76] Inventor: Louie Zeravica, 306 Jefferson St., Russellville, Mo. 65074

[21] Appl. No.: 696,793

[22] Filed: Jan. 31, 1985

[51] Int. Cl.[4] ..... E02F 5/02

[52] U.S. Cl. ..... 37/103; 37/117.5; 414/723

[58] Field of Search ..... 37/103, 117.5, 195; 414/722, 723

[56] References Cited

U.S. PATENT DOCUMENTS

| | | | |
|---|---|---|---|
| 2,857,065 | 10/1958 | Ferwerda | 37/103 |
| 3,139,199 | 6/1964 | van Auwelaer | 37/103 |
| 4,314,789 | 2/1982 | Luigi | 37/103 |

*Primary Examiner*—E. H. Eickholt

*Attorney, Agent, or Firm*—Stewart L. Gitler; Martin P. Hoffman; Mitchell B. Wasson

[57] ABSTRACT

A laterally offset shovel assembly for the boom of a backhoe, or similar excavating machine, enables the backhoe to dig foundations or trenches in previously inaccessible locations. The assembly comprises a tubular member with a bucket securing to one end thereof and a pair of straps secured adjacent to the other end thereof. The conventional bucket is removed and the straps are bolted or otherwise secured to the free ends of the linkages extending along opposite lateral faces of the boom. The power cylinder on the boom transmits power through the linkages to the straps. The straps, in turn, pivot to oscillate the tubular member and the bucket secured thereon to perform digging operations in tight quarters.

8 Claims, 4 Drawing Figures

OFFSET SHOVEL ASSEMBLY FOR USE WITH BACKHOE

FIELD OF THE INVENTION

The invention relates generally to backhoes and similar excavation equipment, and more particularly pertains to an offset shovel assembly that may be removably secured to a backhoe for digging trenches, foundations, and the like.

DESCRIPTION OF THE PRIOR ART

Backhoes are well known excavating machines that utilize a body with an internal combustion engine mounted thereon to power the drive train and advance the backhoe on its endless treads. The backhoe further includes a seat with manual controls, such as joysticks, buttons, etc. for the operator, for operating a longitudinally projecting boom with a bucket secured to its free end. Hydraulically operated cylinders extend, or retract, the pistons that are secured to the bucket by mechanical linkages. The bucket has sharp teeth on its leading edge. The bucket can be tilted toward the cab, dig deeply into the earth, and load the bucket. The boom is then swung to a selected position, and the contents of the bucket are disgorged by tilting the bucket.

Conventional backhoes have found wide-spread acceptance for diverse purposes, within the construction industry. However, because of the size and geometry of the boom and its relationship to the body of the backhoe, as well as the nature of the digging action achieved by the bucket of the backhoe, backhoes have proven incapable of use in tight spaces, as well as under raised structures, unless the structure is raised to a considerable height. Consequently, conventional backhoes can not be employed to dig utility trenches, or foundations under existing homes, or perform similar tasks, and these tasks have only been accomplished by using manual laborers with shovels for prolonged periods of time.

SUMMARY OF THE INVENTION

Thus, with the operational deficiencies of conventional backhoes clearly in mind, the present invention is directed to an offset shovel assembly that enhances the operational capabilities of the backhoe with a minimum of cost and effort. The offset shovel assembly is easily secured to the free end of the longitudinally extending boom of the backhoe in lieu of the conventional bucket, and enables successful digging operations of the backhoe in previously inaccessible areas, such as under mobile homes, in trenches, in foundations, and the like.

The present offset shovel assembly comprises a tubular member with a pair of spaced straps at one end. A shovel with cutting teeth is secured to the opposite end of the tubular member. The bucket of the backhoe is removed, and the straps are bolted to the end of the boom remote from the body of the backhoe. Consequently, the operation of the boom, and the hydraulically powered cylinder and piston operatively associated therewith, positions the offset shovel device and then pivotally moves same.

By virtue of the tubular member, which may be five or more feet in length, the digging action of the offset shovel takes place several feet to the side of the boom, parallel thereto, and laterally offset therefrom. When the digging operation with the offset shovel assembly has been completed, the assembly is unbolted from the boom and the conventional bucket is secured thereto so that the backhoe can be used in the normal manner. Such relatively inexpensive offset shovel assembly enhances the operating capabilities of the backhoe and widens the versatility and capability of this widely used type of excavating equipment.

DESCRIPTION OF THE INVENTION

Figure 1:
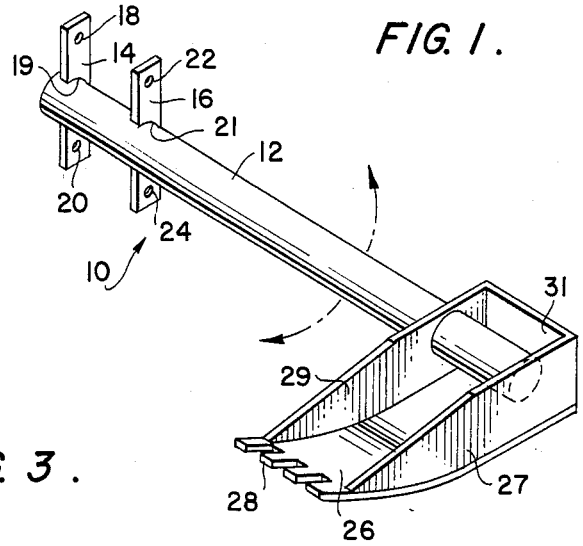
FIG. 1 is a perspective view of the laterally offset shovel assembly for securement to a backhoe, such assembly being constructed in accordance with the principles of the invention.

Referring now to the drawings, FIG. 1 depicts the instant offset shovel assembly for use with conventional backhoes. Such assembly is identified generally by reference numeral 10. Assembly 10 comprises an elongated, study tubular member 12 with a pair of straps 14, 16 welded to one end thereof. Apertures 18, 20, 22, 24 extend through the straps, and are adapted to receive bolts or other fasteners. Cut-outs 19, 21 in each strap receive the tubular member 12.

A bucket 26 is welded or otherwise secured to the opposite end of the tubular member 12. Teeth 28 ar formed on the leading edge of bucket for ripping through the earth or other material to be scooped into the bucket; sidewalls 27, 29, back wall 31, and the bottom wall of the bucket determine the capacity of the bucket.

Figure 3:
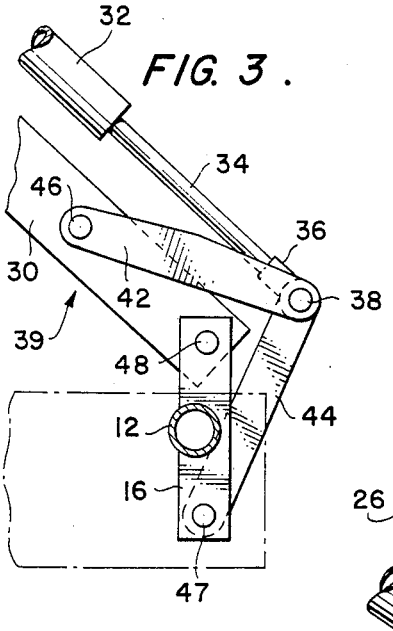
FIG. 3 is a side elevation view, on an enlarged scale, of the shovel assembly and a fragment of the backhoe boom in the rest position, such view being taken along line 3—3 in FIG. 2 and in the direction indicated.
Figure 2:
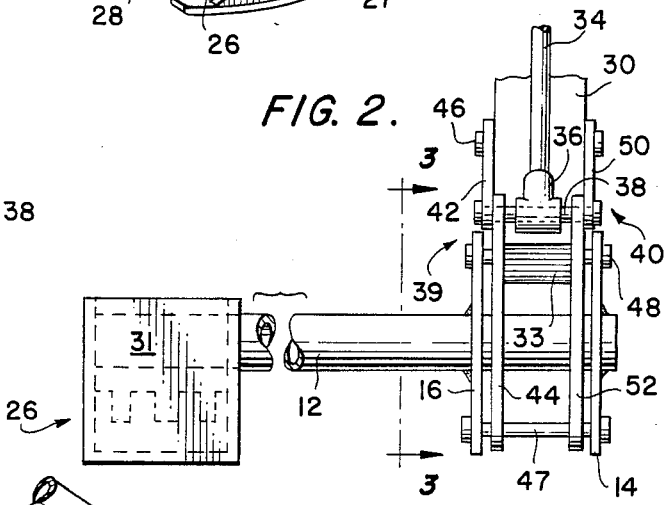
FIG. 2 is a top plan view of the laterally offset shovel assembly secured to the boom of a backhoe, only a fragment of the boom being shown.
Figure 4:
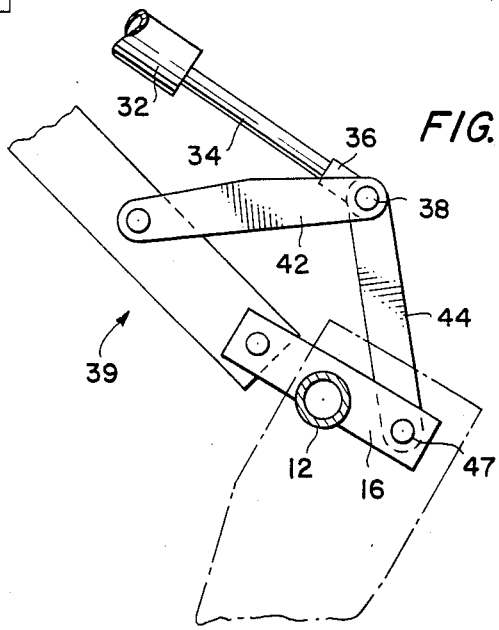
FIG. 4 is a side elevational view identical to FIG. 3, but showing the shovel assembly and a fragment of the backhoe boom in the extended position.

While FIG. 1 shows assembly 10 prior to its securement to the boom of the backhoe, FIGS. 2–4 shows the assembly 10 fastened in position on the backhoe. Only a fragment of the boom 30 of the backhoe is visible including the free end of the boom, and the hydraulic cylinder 32 with its extensible piston rod 34 are situated thereabove. The hydraulic cylinder extends, or retracts, the piston rod 34 relative to cylinder 32 in response to the operation of manual controls by the operator of the backhoe (not shown). A shackle 36 is secured to the end of the piston rod remote from the cylinder 32, and a shaft 38 passes through the shackle 36.

Cylinder 32 and piston rod 34 control, simultaneously, two identical linkages. A first linkage 39 extends along one lateral face of the boom, and a second identical linkage 40 extends along the other lateral face of the boom, as shown in FIG. 2.

Linkage 39 comprises a first link 42 and a second link 44. A pin 46 secures one end of the link 42 to the boom 30, while the other end of the link is secured to shaft 38. The link 42 pivots about pin 46 in response to the extension, and retraction, of piston rod 34, shackle 36, and shaft 38. One end of link 44 is secured to shaft 38, while the other end is secured to pin 47. The link 44 pivots about pin 47 in response to the extension, and retraction, of piston rod 34, shackle 36 and shaft 38.

Link 44 is mounted inboard of strap 16, and shaft 38 passes through aperture 24 in the strap as well as through link 44. A pin 48 passes through aperture 22 in strap 16 and through the end 33 of the boom. Strap 16 pivots about pin 48 relative to boom 48. Strap 16 and tubular member 12 thus are rocked in an arcuate path by the movement of links 42, 44.

Linkage 40 comprises a first link 50 and a second link 52. One end of link 50 is secured upon pin 46, which extends laterally through the boom, while the other end of link 50 is affixed to shaft 38, which also extends laterally through the boom. One end of link 52 is secured to shaft 38, while the other end of link 52 is secured to pin 47.

Strap 14 is mounted outboard of linkage 40. Strap 14 is secured to one lateral side of boom 39 by pin 48, while the other end of strap 14 is mounted parallel to, and adjacently to, link 52 by virtue of pin 47 passing through both members. Linkage 40 translates the extension, and retraction, of piston rod 34 into a rocking motion that is delivered through the straps to tubular member 12 and the bucket 26 secured thereto. The manner and extent of movement of member 12 and the bucket 26 is suggested by the two headed arrow in FIG. 1. The movement of the offset shovel assembly achieves the same functions as would be achieved by a conventional backhoe, albeit at a location laterally offset from the longitudinal axis of the boom. The offset may be to the left, or to the right, of the boom depending upon the projection of the tubular member, and the location of the inaccessible site to be excavated.

The offset shovel assembly 10 is bolted, or otherwise secured in place, after the conventional bucket has been unbolted and removed form engagement with the linkages 39, 40. After the previously inaccessible site has been excavated, assembly 10 is removed and the conventional bucket is again secured to the end of boom 30. These operations are relatively easy to achieve with simple manual tools, and can be undertaken on the job site.

Whereas the foregoing description of a preferred embodiment of the invention has been se forth with particular reference to a backhoe and its boom, the offset shovel assembly is equally applicable to other excavating machines that employ a boom. Furthermore, although cylinders 34 may be hydraulically operated, electrically or pneumatically operated cylinders would function satisfactorily; also, the tubular member 12 may be rectangular in shape, may be hollow or may be fabricated from solid cylindrical stock. Different linkages may be utilized on the boom of the excavating equipment. Thus, the appended claims should not be limited to their specific terms, but should be construed in a liberal sense that captures the essence of this material contribution to the useful arts and sciences.

I claim:

1. A offset shovel assembly adapted to be secured to power driven linkages located upon the boom of an excavating machine, said assembly comprising:

(a) an elongated tubular member extending perpendicular to, and laterally offset from, the boom of said machine, (b) a bucket secured to said tubular member adjacent one end thereof, (c) a pair of straps secured to said tubular member adjacent the opposite end thereof, (d) said straps being spaced apart a distance sufficiently great to receive the boom therebetween, (e) apertures formed in said straps above and below said tubular member, and (f) fastener means passing through said apertures to secure said assembly in operative relationship to the boom, whereby operation of the linkages on the boom will impart movement to said straps and operate said bucket.

2. The offset shovel assembly of claim 1 wherein said tubular member is a hollow cylindrical shaft.

3. The offset shovel assembly of claim 1 wherein a cut-out section is defined in the mid-section of each strap, so that the tubular member is received therein.

4. The offset shovel assembly of claim 1 wherein the bucket includes wide walls, a bottom wall, and a rear wall, and the tubular member passes through one side wall of the bucket and is welded to the second side wall.

5. An excavating machine including a boom, a power cylinder with an extensible piston rod mounted along the longitudinal axis of said boom, a first linkage extending longitudinally along one side of said boom and a second identical linkage extending longitudinally along the other side of said boom, each linkage including a first link fixed at one end to said piston rod and at its opposite end to said boom for pivotal movement relative to said boom, each linkage further including a second link secured at one end to said piston rod, the invention comprising an offset shovel assembly that is joined to said first and second linkages, said offset shovel assembly comprising:

(a) an elongated tubular member extending perpendicular to, and laterally offset from, the longitudinal axis of the boom of the backhoe;

(b) a bucket secured to said tubular member adjacent one end thereof, (c) a pair of straps secured to said tubular member adjacent the opposite end thereof, (d) said straps being spaced apart a lateral distance sufficiently great to receive the boom and the linkages therebetween, (e) apertures formed in said straps above and below said tubular member, and (f) fastener means passing through said straps and into the second links of each linkage to secure said assembly to the boom for operation by said power cylinder.

6. The invention as defined in claim 5 wherein each strap has a centrally located cut-out portion for receiving said tubular member.

7. The invention as defined in claim 4 wherein each strap is situated outboard of the linkage to which it is joined.

8. The invention as defined in claim 5 wherein each strap is secured at one end to said boom and at its oppostie end to a linkage, whereby said strap pivots relative to the boom to operate the bucket secured to the opposite end of said tubular member.

* * * * *